United States Patent [19]

Bione et al.

[11] Patent Number: 4,524,665

[45] Date of Patent: Jun. 25, 1985

[54] DYNAMIC CONTROLLER FOR SAMPLING CHANNELS IN AN ELECTRONIC ORGAN HAVING MULTIPLEXED KEYING

[75] Inventors: Angelo A. Bione, Elmhurst; Brian M. Bagus, Bartlett, both of Ill.

[73] Assignee: The Marmon Group, Inc., Chicago, Ill.

[21] Appl. No.: 505,312

[22] Filed: Jun. 17, 1983

[51] Int. Cl.[3] ..... G10H 1/18; G10H 7/00

[52] U.S. Cl. ..... 84/1.01; 84/DIG. 10; 340/365 S

[58] Field of Search ..... 84/1.01, 1.03, DIG. 10; 340/365 R, 365 S

[56] References Cited

U.S. PATENT DOCUMENTS

| | | | |
|---|---|---|---|
| 3,899,951 | 8/1975 | Griffith et al. | 84/1.01 |
| 3,902,397 | 9/1975 | Morez et al. | 84/1.01 X |
| 4,041,826 | 8/1977 | Oya | 84/1.01 |
| 4,138,916 | 2/1979 | Kitagawa | 84/1.01 |
| 4,179,968 | 12/1979 | Suzuki | 84/1.01 |
| 4,227,432 | 10/1980 | Bagus | 84/1.01 |
| 4,238,985 | 12/1980 | Adachi | 84/1.01 |
| 4,409,876 | 10/1983 | Katoh | 84/1.01 |

*Primary Examiner*—Stanley J. Witkowski

*Attorney, Agent, or Firm*—Neuman, Williams, Anderson & Olson

[57] ABSTRACT

The present invention is a circuit for controlling the sampling of plurality of channels in an electronic organ having multiplexed keying. The channels having information signals at a particular time period is sensed and used to address a memory. The memory has stored a plurality of sequences of digital signals for controlling the multiplexing and demultiplexing operations of the organ. Only those channels containing information signals are sampled which accordingly increases the sampling rate which increases the frequency of the harmonic component of the square wave signals that can be passed by the system and the distortion caused by aliasing of harmonics is diminished.

5 Claims, 2 Drawing Figures

DYNAMIC CONTROLLER FOR SAMPLING CHANNELS IN AN ELECTRONIC ORGAN HAVING MULTIPLEXED KEYING

BACKGROUND OF THE INVENTION

1. Field of Invention

The invention relates to electronic musical instruments and in particular to an electronic organ having multiplexed keying. In such organs input lines containing various information signals are sampled under the control of a fixed clock and time division multiplexed for subsequent use in the organ and for the ultimate production of audio waveforms. The audio output signals from such organs contain distortion caused by passing square wave signals with harmonic components at a frequency above that tolerated by the sampling rate. The present invention determines the input lines actually containing information signals at a particular point in time and accordingly controls the sampling of only those active input lines. The limitation of the sampling to only active input lines increases the sampling rate which in turn increases the frequency of the harmonic component of the square wave signals that can be passed by the system without distortion.

2. Description of the Prior Art

Electronic organs having multiplexed keying are well known, such as the organ described in U.S. Pat. No. 4,227,432 entitled "Electronic Musical Instrument Having Multiplexed Keying" which issued on Oct. 14, 1980 and is made a part of this specification by reference. In the above multiplexed organ various input lines containing harmonic information, namely upper manual drawbar, percussion, lower manual drawbar and pedal drawbar are sampled and time division multiplexed for subsequent use in keyer circuits. In addition, other input lines containing keying information, namely upper manual sustain, upper manual percussion, lower manual and pedals are sampled and time division multiplexed for subsequent use with the time division multiplexed harmonic information in the keyer circuits. The output of the keyer circuits is demultiplexed and applied to a plurality sine filters. The outputs of the sine filters are applied to standard amplifier circuits and speakers to provide an audio output. The multiplexed organ is controlled by a counter circuit which synchronizes the sampling of each of the input lines containing harmonic information with the sampling of the input lines containing keying information and controls the multiplexing and demultiplexing operations.

In the above described system each input line containing harmonic information and the corresponding input line containing keying information is sampled without regard to whether that line actually contains any information signals. The counter circuit controls the sampling, multiplexing and demultiplexing and receives a 1 MHz clock signal, thus the sampling rate for the system with four channels of harmonic information is 250 KHz. In accord with the Nyquist Theorem the highest frequency tolerated without distortion is one-half the frequency of the sample rate or in the above example 125 KHz. If a frequency with harmonic components above the maximum 125 KHz is received, an undesirable distortion known as aliasing occurs. Aliasing is the introduction of error into the Fourier Analysis of a discrete sampling of continuous data when components with frequencies too great to be analyzed with the sampling internal or rate being used contribute to the amplitudes of lower frequency components.

In an electronic organ using a tone signal in the form of a square wave which is rich in harmonic components aliasing causes the harmonic components above the maximum frequency determined by the sampling rate to foldback below the maximum frequency and to occur in the audio output as distortion or spurious signals. This type of distortion is illustrated in the graph of FIG. 1.

In FIG. 1 the coordinate axis represents the amplitude of the harmonics and the abscissa axis represents the frequency. The graph of FIG. 1 is not drawn to scale and is intended only to illustrate the principle of aliasing. For a signal with a fundamental frequency of a given amplitude A each odd harmonic has a reduced amplitude. For example, the third harmonic has an amplitude approximately one-third of the funamental and the ninth harmonic has an amplitude one-ninth of the fundamental. If the sampling rate is set at 250 KHz for four inputs lines or phases as discussed above, the maximum frequency or Nyquist frequency before aliasing occurs is 125 KHz. If the signal passing through the system has a fundamental frequency of 18 KHz with an amplitude of A, then the third harmonic has a frequency of 54 KHz and an amplitude of $\frac{1}{3}$ A. The frequency of the seventh harmonic is 126 KHz and the amplitude is 1/7 A. Since the frequency of the seventh harmonic is greater than 125 KHz, aliasing occurs and the seventh harmonic appears in the output as distortion or a spurious signal occuring at 124 KHz. This distortion caused by aliasing is shown in FIG. 1. The ninth harmonic and the eleventh harmonic also appear in the output as distortion or spurious signals at 88 KHz and 52 KHz respectively, not shown in FIG. 1 for the sake of clarity. When the aliasing frequency components occur within the audible frequency range (approximately 20 Hz through 20 KHz) the audio output signal becomes distorted or contains spurious signals. The listener commonly hears this distortion as a implement sounds noise in the audio output and, of course, this detracts from the listening pleasure. However, the aliasing distortion due to the seventh harmonic appearing as a signal of 124 KHz frequency and a 1/7 A amplitude as well as the distortion caused by the ninth and eleventh harmonic are well outside the audio frequency range. Therefore, the distortion is not considered as a serious impediment to the generation of musical sounds.

This same type of aliasing distortion is also created due to the thirteenth harmonic of the 18 KHz fundamental. The thirteenth harmonic is a signal at 234 KHz with an amplitude of 1/13 A (A is the amplitude of the 18 KHz fundamental). Since the Nyquist frequency is 125 KHz the distortion due to aliasing generates a spurious signal at 16 KHz with an amplitude of 1/13 A. The aliasing distortion for the thirteenth harmonic of the 18 KHz fundamental occurs within the audio frequency range and therefore, the distortion can be heard by the listener and it detracts from the music. Of course, aliasing distortion continues to occur as the harmonics increase, however since the amplitude of the harmonic signal decreases with increasing frequency the distortion caused by higher harmonics is less noticeable.

In prior electronic organs each line containing input information is sampled even though no data is on the line. As a result the sampling rate is fixed and aliasing occurs at the frequency determined by the Nyquist theorem. If input information is only on two of the four input lines and all four lines are nevertheless sampled, the sample rate is half of that actually required and aliasing occurs at a frequency much lower than necessary. Furthermore, since the amplitude of the harmonics decreases with increasing frequency the lower the Nyquist frequency the greater and more noticeble is the distortion.

It is a general object of the present invention to provide a dynamic controller circuit for use in an electronic organ having multiplexed keying for reducing distortion in the audio signal caused by aliasing.

It is a specific object of the present invention to provide a dynamic controller for use in an electronic organ having multiplexed keying and a plurality of lines at least some of which having a harmonic content signal at any point in time for sensing and sampling only those lines containing a harmonic content signal from the plurality of lines to effectively increase the sample rate if all lines do not contain a harmonic content signal.

SUMMARY OF THE INVENTION

The present invention is a dynamic controller circuit for use in an electronic musical instrument, in particular an electronic organ having multiplexed keying of the type disclosed in U.S. Pat. No. 4,227,432. The dynamic controller determines or senses the input lines to the organ having harmonic content information and through a ROM controls timing information and the sampling rate for the number of active input lines or channels. The dynamic controller conforms the input lines sampled to the input lines containing information. In the present invention, if the number of input lines with harmonic information decreases for any period of time, the controller only samples those lines having harmonic information and the corresponding lines having keying information. Therefore, for this period of time, the sample rate increases and in accord with the Nyquist Theorem, the highest frequency tolerated by the system, one-half the sample rate, increases. Since the Nyquist frequency for the system increases, the frequency at which aliasing distortion occurs becomes higher and since the amplitude of the harmonic signal affected by aliasing decreases with increasing frequency, the amount or level of distortion in the audio signal is reduced.

The dynamic controller circuit receives signals indicating whether harmonic information is present on the output lines of various circuits, such as upper manual drawbars, percussion, lower manual drawbars and others. These indicating signals form part of an address signal which is applied as the input to a ROM. The ROM has stored in its memory a plurality of sequences of output signals corresponding to the input address indicated in part by the active input lines. The ROM also receives as part of the input address an inverted signal from the clock divided down to an appropriate rate such as 1 MHz. During one polarity of the clock signal, the ROM provides timing information on some of its output lines corresponding to the number of input lines or phases or channels to be sampled. Upon changing to the second polarity of the clock signal, the timing information is applied to the input of the ROM through a timing latch which functions as a counter. During the second polarity of the clock signal a new address is provided at the input to the ROM and data information stored in the ROM is applied to at least some of its output lines. Upon change to the original polarity of the clock signal, the data on the output lines of the ROM is applied through a data latch and together with timing information generated in an inhibit logic circuit to the remainder of the organ circuitry to control which input lines or phases are sampled and to control the multiplex and demultiplex operations. Under the control of the clock and the self-counting feature of the timing latch, the ROM provides data information for the appropriate duration based upon the number of active input lines.

In the present invention, the number of lines sampled varies with the number of lines having harmonic content information signals. If fewer than all of the lines have information signals at a specific point in time then the sample rate is increased and the Nyquist frequency is increased. Under these circumstances, the frequency at which aliasing occurs is increased and the amplitude of the harmonic signals which cause distortion is smaller. Of course, if the amplitude of the distortion is smaller it is less noticeable to the listener and the output music signal is improved.

If a particular type of harmonic information, for example upper manual drawbars is not in use, the d.c. bias at the sample and hold gate at the demultiplexer will begin to drift until it settles at an equilibrium point. Under these circumstances, if that particular channel is put back into use, the sample and hold capacitor charges rapidly and creates audio distortion in the output. To avoid this problem, a d.c. resotration circuit is used which periodically provides an input to the ROM to change the input address. In response to the new address the ROM provides an output that controls the sampling of all input channels or at least those input channels not first sampled by the last output sequence from the ROM thereby refreshing the sample and hold capacitors and avoiding rapid charging after prolonged periods of non-use with the attendant distortion.

BRIEF DESCRIPTION OF THE DRAWINGS

The present invention will be more clearly understood from the following detailed description of the specific embodiment, read in conjunction with the accompanying drawings, wherein.

It should be understood that the drawings are not necessarily to scale and that the embodiments are illustrated by graphic symbols and diagrammatic representations. In certain instances, details which are not necessary for an understanding of the present invention or which render other details difficult to perceive may have been omitted. It should be understood, of course, that the invention is not necessarily limited to the particular embodiment illustrated herein.

DETAILED DESCRIPTION

Figure 1:
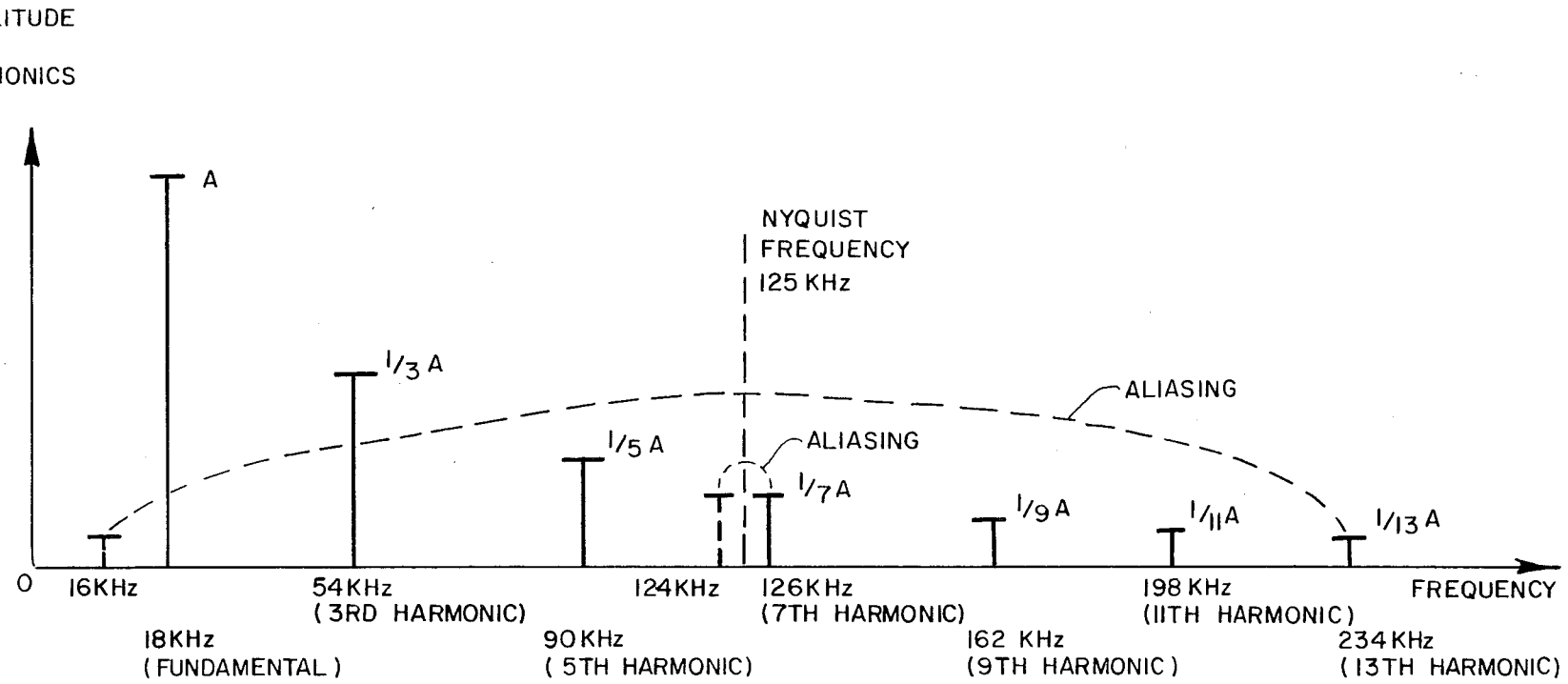
FIG. 1 is a graph illustrating the aliasing distortion occuring in a system with a sample rate of 250 KHz and a fundamental frequency of 18 KHz.
Figure 2:
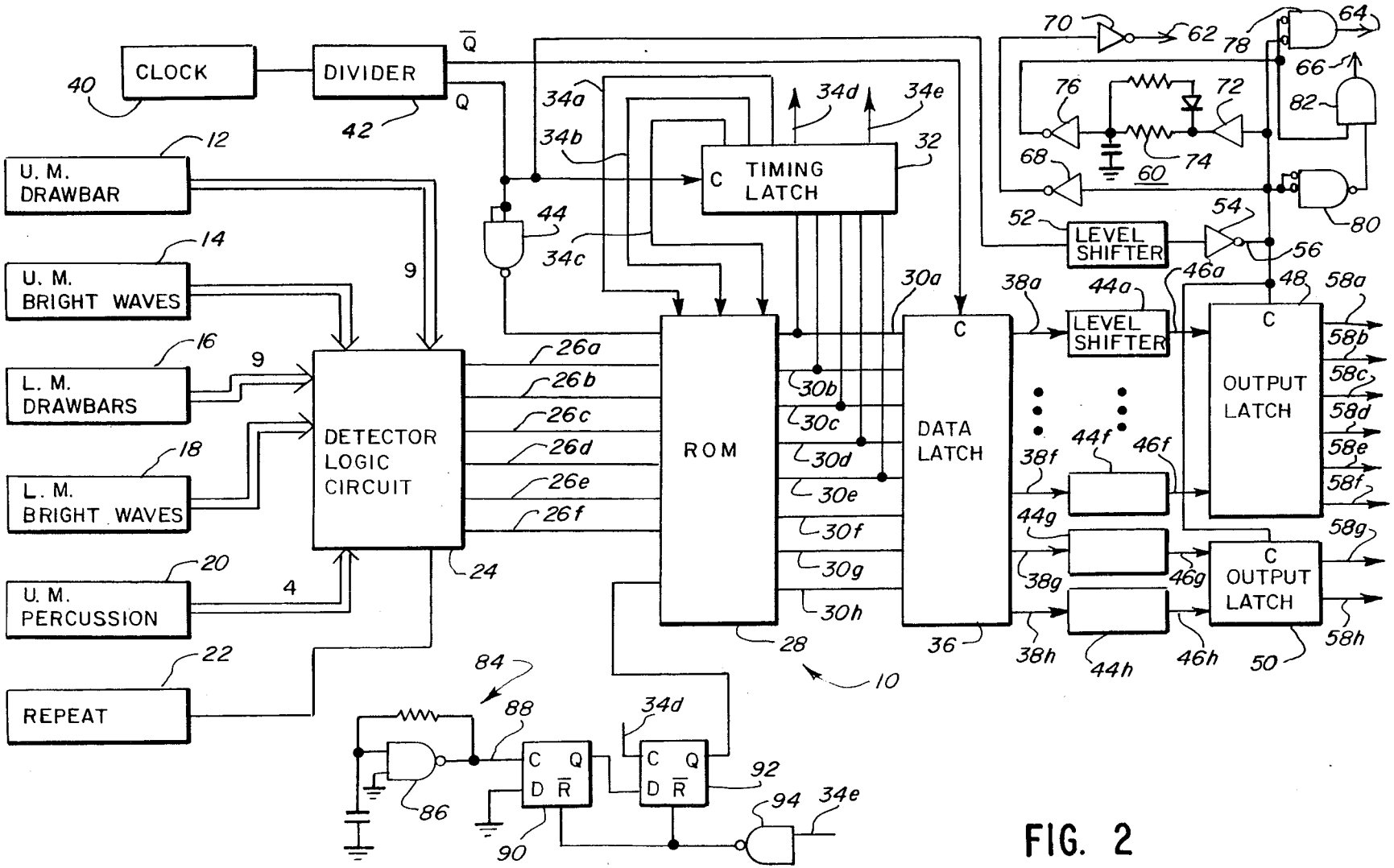
FIG. 2 is a partial block diagram of the dynamic controller of the present invention.

FIG. 2 shows the dynamic controller circuit 10 of the present invention. A plurality of harmonic content circuits, namely, upper manual drawbars 12, upper manual bright waves 14, lower manual drawbars 16, lower manual bright waves 18, upper manual percussion 20 and repeat 22 provide input signals to a detector logic circuit 24. The number of harmonic content circuits could be reduced or others could be added to the above group without departing from the scope of the present invention. The input signals from each harmonic content circuit indicates that the organist is using that particular circuit. For example, if the organist has pulled out two of the upper manual drawbars a logic 1 signal is placed upon two of the nine lines leading to the detector logic circuit 24.

The detection logic circuit 24 OR's together the logic signals from each of the harmonic content circuits and appropriately provides signals on output lines 26A to 26F. For example, if the organist in addition to pulling out two drawbars on an upper manual drawbars also pulls out three lower manual drawbars and turns on the upper manual percussion tab, then two lines from the upper manual drawbars are at logic 1, three lines from the lower manual drawbars are at a logic 1 and a single line for the upper manual percussion tab is at a logic 1. The detection logic circuit 24 OR's together the two input lines from the upper manual drawbars and provides a logic 1 level signal on the output line 26A, similarly the three input lines from the lower manual drawbars are ORed together and a logic 1 level signal placed on output line 26C, similarly the input signal from the upper manual percussion tab causes detector logic circuit 24 to place a logic 1 level signal on output line 26E. Since no input signal is received from the upper manual bright waves, lower manual bright waves or the repeat circuit the output lines 26B, 26D and 26F remain at a logic 0 level. The circuit structure of detector logic circuit 24 is well within the ability of one of ordinary skill in the art and in the preferred embodiment simply includes OR gates receiving the on/off type input signals from the armonic content circuits.

Each output line 26A through 26F is at a logic state 1 if its associated harmonic content circuit is in use and is at a logic state 0 if its associated harmonic content circuit is not operating. The output lines 26A through 26F of the detector logic circuit 24 are connected to the input of ROM28 and serve as a partial address.

In ROM28 there is stored a plurality of sequences of digital signals which are placed on theo output lines 30A through 30*h*. The output lines 30*a* through 30*e* of the ROM28 are connected as inputs to the timing latch 32. The timing latch 32 has a plurality of output lines 34*a* through 34*e*. The output lines 30*a* through 30*e* together with the output lines 30*f* through 30*h* are connected as input to the data latch 36. The output lines 38*a* through 38*f* of the data latch 36 are connected to standard level shifter circuits 44*a* through 44*f* respectively and then to the output latch 48 and the output lines 38*g* through *h* are connected to standard level shifter circuits 44*g* through 44*h* respectively and then to output latch 50. The output latch 48 has a plurality of output lines 58*a* through 58*f* and output latch 50 has output lines 58*g* and 58*h*. The output lines 58*a* through 58*h* are connected to the multiplexers and demultiplexers of the organ shown in U.S. Pat. No. 4,227,432 to control the sampling in accord with the sequence stored in ROM28.

A clock 40 is connected to a divider circuit 42. The divider circuit has a Q output line and $\overline{Q}$ output lines. The Q output line is connected to the clock input of timing latch 32 and also to inverter 44. The output of inverter 44 is connected to the input of ROM28 and also forms part of the address signal. The $\overline{Q}$ output line of divider 42 is connected to the clock input of data latch 36. The actual sequences of digital signals stored in the ROM28 can be varied and is determined by the need to control the remaining organ circuitry in the manner described with reference to counter circuit 29 which controls the operation of the circuit in U.S. Pat. No. 4,227,432.

In the preferred embodiment the clock 40 runs at 2 MHz and is reduced down to 1 MHz by divider circuit 42. When the Q output line is at a logic 0 state, the $\overline{Q}$ output line is at logic 1 state and the output of inverter 44 is at a logic 1 state. Based upon the address on lines 26*a* through 26*f* and the logic 1 at the output of inverter 44, ROM28 places appropriate timing information at its output lines 30*a* thorugh 30*e* connected to timing latch 32. As the signal on line Q changes from a logic 0 to a logic 1 the positive edge clocks timing latch 32 and applies the timing signals on lines 30*a* through 30*c* back as inputs on lines 34*a* through 34*c* to the ROM28. While the output of inverter 44 is at a logic 0 state, ROM28 applies data signals to the output lines 30*a* through 30*h*. As the signal on line Q changes from a logic 0 to a logic 1, the positive edge clocks data latch 36 and applies the data signals from ROM28 to the output lines 38*a* through 38*h* of data latch 36.

The above sequence is repeated for three clock cycles since the input lines 26*a* through 26*f* indicate that three channels are active. The timing latch 32 functions as an internal clock for the operation of the ROM28. The complete sequence of the circuit is shown below.

CHART 1

| | | | | | | | |
|---|---|---|---|---|---|---|---|
| Q | 0 | 1 | 0 | 1 | 0 | 1 | 0 |
| $\overline{Q}$ | 1 | 0 | 1 | 0 | 1 | 0 | 1 |
| Inv. 44 | 1 | 0 | 1 | 0 | 1 | 0 | 1 |
| | Timing Output ROM Lines 30 | Timing Input Lines 34 Data Output ROM Lines 30 | Timing Output Lines 30 Data Output Lines 38 | Timing Input Lines 34 Data Output ROM Lines 30 | Timing Output Lines 30 Data Output Lines 38 | Timing Input Lines 34 Data Output ROM Lines 30 | Timing Output Lines 30 Data Output Lines 38 |

The output lines 34*a* through 24*c* of the timing latch 32 follow the sequency 001, 010 and 011 indicating that three harmonic circuits are active. The output lines 38*a* through 38*h*, follow the sequence 11000000, 10010100 and 00010110 for upper drawbars, lower drawbars and percussion respectively. The output lines 38*a* through 38*f* of the data latch 36 are connected to inverting level shifters 44*a* through 44*a* and output lines 38*g* through 38*h* of the data latch 36 are connected to inverting level shifters 44*g* and 44*h*. Inverting level shifters are well known circuits to those of ordinary skill in the art and a further description is considered unnecessary. Each level shifter changes the input signal which is a 0 and negative 5 V signal to an output signal which is a 0 and negative 14 V signal. This output signal ranges is necessary for subsequent organ circuits. The output lines 46*a* through 46*f* of level shifters 44*a* through 44*f* are connected as inputs to output latch 48 and the output lines 46*g* and 46*h* of level shifters 44*g* and 44*h* are connected as inputs to output latch 50. It should be understood by those or ordinary skill in the art that a signal eight input latch could be used in place of the two output latches 48 and 50.

The Q output line of the divider 42 is applied to the input of inverting level shifter 52 the output of which is applied to the input of inverter 54. The clock output signal from inverter 54 on line 56 is connected to the clock inputs of output latches 48 and 50 which on the positive edge transistion of the signal clocks the signals on the input lines 46*a* through 46*h* to the output lines 58*a* through 58*h* of output latches 48 and 50. Due to the nature of the level shifter circuits 44*a* through 44*h* the signal on lines 38*a* through 38*h* is delayed and the use of the output latches 48 and 50 compensates for the delay to assure that the signals on the output lines 58*a* through 58*h* are synchronous and proper for subsequent use in the standard organ.

The clock signal on line 56 is applied to an inhibit signal generating circuit 60. The inhibit signal generating circuit 60 provides three inhibit signals on lines 62, 64 and 66. The clock signal on line 56 is applied to inverters 68 and 70. The output of inverter 70 is applied to output line 62. The clock signal on line 56 is also applied as the input to inverter 72 the output of which is connected to delay circuit 74 the output of which is connected to inverter 76. The output of inverter 76 and the clock signal on line 56 are applied as inputs to NOR gate 78 the output NOR gate 78 is applied to output line 64. The clock signal on line 56 is also applied to the inputs of NOR gate 80. The output of NOR gate 80 and the output of inverter 76 are applied as inputs to NOR gate 82. The output of NOR 82 is applied to output line 66. The inhibit signals on output lines 62, 64 and 66 are delayed slightly in comparison to the output signals on lines 58*a* through 58*h*.

The output lines of latches 48 and 50 and the output lines of inhibit generating circuit 60 are applied to the organ circuitry of U.S. Pat. No. 4,227,432 as follows: lines 58*a* and 58*b* are applied to the multiplexer for keying information; lines 58*c* and 58*d* and 66 are applied to the demultiplexer; lines 58*e*, 58*f* and 62 are applied to the multiplexer for harmonic content information; and, lines 58*g*, 58*h* and 64 are applied to the bright wave circuits. The manner in which the multiplexers and demultiplexers are controlled is well within the ability of one of ordinary skill in the art and accordingly is not discussed further.

A d.c. restoration circuit 84 is provided to assure that the sample and hold capacitors of the demultiplexer are charged preventing the d.c. bias on these capacitors from decaying or drifting. If a particular channel is not used for a period of time the d.c. bias on the sample capacitor begins to drift towards a natural equilibrium. After the d.c. bias has decayed to this natural equilibrium if the channel is then activated the capacitor will rapidly charge causing audible noise distortion. To prevent the d.c. bias of these capacitors from drifting each channel is periodically included within the sampling sequence to refresh or charge the d.c. bias on the sampling capacitor.

The d.c. restoration circuit 84 receives input signals from timing latch 32 and provides a restoration signal output to the ROM28. The restoration circuit 84 comprises an oscillator circuit 86 which provides a continuous series of pulses at output 88. The pulses on line 88 are applied to the C input of bistable 90. The D input of bistable 80 is tied to ground so that the Q output is at a logic 1 level for each pulse received at the C input. The Q output of bistable 90 is applied to the D input of bistable 92. The C input of bistable 92 is connected to output line 34*d* from timing latch 32. At the end of each standard sequencing from the timing latch 32 determined from the memory location addressed by the inputs to ROM28 a positive logic 1 level signal is applied to the output line 34*d* which together with the logic 1 level input to the D input of bistable 92 applies a logic 1 level signal an output line Q. The Q output line is applied to the ROM28 and functions to provide a special address to the ROM28. In response to the special address on the Q output line ROM28 provides a special output sequence so that all channels or harmonic content circuits are sampled regardless of whether or not the lines are active. An an alternative, the special address from d.c. restoration circuit 84 could select less than all the channels to be sampled. After ther termination of the special sequence, in the preferred embodiment the sampling of all six channel, the timing latch 32 provides an output on line 34*e*. The signal on line 34*e* is applied as the input to OR gate 94, the output of which is applied to the reset inputs of bistables 90 and 92 and accordingly the Q output of bistable 92 returns to the logic level 0. Under these conditions the output of ROM28 is again under control of the address lines from the detector logic circuit 24 and the inverter 44.

From the above description, it is apparent that the objects of the present invention have been acheived. While only the preferred embodiment has been set forth, alternative embodiments and various modifications will be apparent from the above description to those skilled in the art. These and other alternatives are considered equivalents and are considered within the spirit and scope of the present invention.

What is claimed is:

1. A dynamic controller circuit for use in a multiplexed organ having a plurality of channels, a detector means having a plurality of output lines and being connected to each of said channels for providing an output signal on respective ones of said output lines to indicate that a respective channel contains an information signal, and means connected to each channel for sampling said channel information signal, said dynamic controller comprising:

a memory for receiving said output signals from said detector means as an address and having a plurality of digital sequences stored at different memory locations and having a plurality of memory output lines;

a clock circuit for providing a timing signal to said memory;

said timing signal having a first polarity and a second polarity;

said memory upon receiving said address signals from said detector means and said first polarity timing signal places a sequence of digital signals for use as timing signals upon at least some of said memory output lines, a timing latch connected to said at least some of said memory output lines for receiving said sequence of digital signals for use as timing signals and having a plurality of timing output lines for providing counting signals; and at least some of said output lines of said timing latch connected to the input of said memory.

2. A dynamic controller as set forth in claim 1 wherein said memory in response to said second polarity timing signal, said output signals from said detector means and said counting signals from said timing latch places a sequence of digital signals upon at least some of said memory output lines for use in sampling only said channels having information systems.

3. A dynamic controller as set forth in claim 2 further comprising:

a data latch connected to said at least some of said memory output signal lines for receiving said sequence of digital signals for use as data signals and having a plurality of output lines;

said data latch also receiving said timing signal and passing said data signals to said output lines for use in sampling only said channels having information signals.

4. A dynamic controller as set forth in claim 3 further comprising an inhibit generator circuit connected to said timing signal and having a plurality of inhibit output lines, said generator circuit receiving said timing signal and providing a plurality of output inhibit signals on said inhibit output lines for use in sampling only said channels having information signals.

5. A dynamic controller as set forth in claim 1 further comprising;

a restoration circuit receiving at least one of said counting signals from said timing latch and having a restoration output signal;

said memory receiving said restoration output signal as an address and providing a sequence of digital output signals upon said memory output lines for use in sampling at least some of said channels not having information signals.

* * * * *